US006761203B1

(12) United States Patent
Huang

(10) Patent No.: US 6,761,203 B1
(45) Date of Patent: Jul. 13, 2004

(54) BALANCED WINDOW BLIND HAVING A SPRING MOTOR FOR CONCEALED PULL CORDS THEREOF

(75) Inventor: Tai-Long Huang, No. 382, Yuan-Lu Rd., Sec. 1, Fuhsing, Changhua (TW)

(73) Assignee: Tai-Long Huang, Fuhsing (TW)

( * ) Notice: Subject to any disclaimer, the term of this patent is extended or adjusted under 35 U.S.C. 154(b) by 0 days.

(21) Appl. No.: 10/403,394

(22) Filed: Mar. 31, 2003

(51) Int. Cl.[7] ..... E06B 9/30
(52) U.S. Cl. ..... 160/170; 160/192
(58) Field of Search ..... 160/170, 171, 160/172 R, 84.04, 84.05, 192; 185/37, 39, 45; 242/373

(56) References Cited

U.S. PATENT DOCUMENTS

| | | | | |
|---|---|---|---|---|
| 361,019 | A | 4/1887 | Morstatt | |
| 425,542 | A | 4/1890 | Hantsche, Jr. | |
| 842,969 | A | 2/1907 | Ostermann | |
| 1,015,144 | A | 1/1912 | Daly | |
| 1,613,364 | A | 1/1927 | Thompson | |
| 1,830,487 | A | 11/1931 | Samberg | |
| 2,209,384 | A | 7/1940 | Brown | 189/62 |
| 2,524,373 | A | 10/1950 | Bopp et al. | 160/166 |
| 3,110,936 | A | 11/1963 | Berard | 20/62 |
| 3,253,664 | A | 5/1966 | Sauber et al. | 175/72 |
| 3,368,798 | A | 2/1968 | Kusel et al. | 256/65 |
| 3,446,263 | A | 5/1969 | Roth | 160/120 |
| 3,478,807 | A | 11/1969 | Hertzberg | 160/344 |
| 3,593,772 | A | 7/1971 | Abraham | 160/84 |
| 3,783,768 | A | 1/1974 | Caming et al. | 98/110 |
| 3,851,699 | A | 12/1974 | Shapiro | 160/166 |
| 3,991,518 | A | 11/1976 | Ishihara | 49/75 |
| 4,102,381 | A | 7/1978 | Bratschi | 160/168 |
| 4,268,995 | A | 5/1981 | Villa | 49/87 |
| 4,275,762 | A | 6/1981 | Field | 137/601 |
| 4,582,109 | A | 4/1986 | Fairbanks | 160/84 R |
| 4,643,081 | A | 2/1987 | Vicinanza et al. | 98/114 |
| 4,679,610 | A | 7/1987 | Spraggins | 160/107 |
| 4,850,138 | A | 7/1989 | Watanabe et al. | 49/84 |
| 4,951,925 | A | 8/1990 | Schultz et al. | 256/65 |
| 4,974,362 | A | 12/1990 | Briggs, Sr. | 49/90 |
| 4,979,551 | A | 12/1990 | Schön | 160/84.1 |
| 4,991,823 | A | 2/1991 | Stanish, Jr. | 256/1 |
| 5,001,864 | A | 3/1991 | Truscott | 49/403 |
| 5,012,552 | A | 5/1991 | Wulf | 16/87.4 R |
| 5,016,701 | A | 5/1991 | Vore | 160/241 |
| 5,082,043 | A | 1/1992 | Moreno | 160/90 |

(List continued on next page.)

FOREIGN PATENT DOCUMENTS

| | | |
|---|---|---|
| CA | 2276387 | 6/2000 |
| EP | 1 134 782 A2 | 9/2001 |
| JP | 05328897 A | 12/1993 |
| WO | WO 97/34682 | 9/1997 |
| WO | WO 99/22777 | 5/1999 |
| WO | WO 00/78368 | 12/2000 |
| WO | WO 01/28391 | 4/2001 |
| WO | WO 01/56624 | 8/2001 |
| WO | WO 01/58327 | 8/2001 |

*Primary Examiner*—David Purol
(74) *Attorney, Agent, or Firm*—Ohlandt, Greeley, Ruggiero & Perle, L.L.P.

(57) ABSTRACT

A window blind includes a head rail, a bottom rail, and an expandable window covering. A pair of pull cords interconnect the head rail, the bottom rail and the expandable window covering. A spring motor includes a drive drum, a pair of cord spools, a spiral spring, and a friction imposing mechanism. The drive drum is mounted rotatably on the head rail. Each of the cord spools is mounted to rotate with and is disposed on a respective side of the drive drum, and is connected to a respective one of the pull cords. The spiral spring provides a biasing force acting on the drive drum. The friction imposing mechanism provides a friction force acting on one of the drive drum and the pull cords. The biasing force and the friction force cooperate to retain the bottom rail at a desired vertical distance relative to the head rail.

7 Claims, 7 Drawing Sheets

U.S. PATENT DOCUMENTS 5,170,830 A * 12/1992 Coslett ..... 160/84.04
5,187,896 A 2/1993 Ross ..... 49/74.1
5,191,735 A 3/1993 Ross ..... 49/74 L
5,216,837 A 6/1993 Cleaver et al. ..... 49/82.1
5,238,042 A 8/1993 Guerrico-Echeverria .... 160/104
5,297,607 A 3/1994 Beauchamp ..... 160/84.1 C
5,323,834 A 6/1994 Toti ..... 160/84.1 C
5,392,833 A 2/1995 Ohanesian ..... 160/89
5,439,042 A 8/1995 Ohanesian ..... 160/89
5,469,658 A 11/1995 Digianni ..... 49/82.1
5,531,257 A * 7/1996 Kuhar ..... 160/168.1 P
5,548,925 A 8/1996 Marocco ..... 49/74.1
5,566,738 A 10/1996 Yadidya ..... 160/133
5,603,369 A 2/1997 Colson et al. ..... 160/84.06
5,715,883 A 2/1998 Keith ..... 160/168.1 V
5,749,404 A 5/1998 Colson ..... 160/84.04
5,778,598 A 7/1998 Ohanesian ..... 49/74.1
5,806,394 A 9/1998 Marocco ..... 83/197
5,937,927 A 8/1999 Keith ..... 160/89
6,012,506 A * 1/2000 Wang et al. ..... 160/170
6,024,154 A * 2/2000 Wang et al. ..... 160/170
6,098,246 A 8/2000 Moir ..... 16/87.2
6,167,789 B1 1/2001 Daniels et al. ..... 83/13
6,186,213 B1 2/2001 Senesac ..... 160/89
6,196,099 B1 3/2001 Marocco ..... 83/197
6,257,300 B1 7/2001 Brownlie ..... 160/84.01
6,283,192 B1 * 9/2001 Toti ..... 160/170
6,289,965 B1 * 9/2001 Ruggles ..... 160/173 R
6,318,661 B1 * 11/2001 Martin et al. ..... 242/373
6,330,899 B1 * 12/2001 Ciuca et al. ..... 160/170
6,334,477 B1 1/2002 Moir ..... 160/168.1
6,336,388 B1 1/2002 Marocco ..... 83/454
6,508,293 B1 * 1/2003 Huang ..... 160/170
6,571,853 B1 * 6/2003 Ciuca et al. ..... 160/192
6,575,223 B1 * 6/2003 Chung et al. ..... 242/378.4
6,644,372 B2 * 11/2003 Judkins ..... 160/84.04
6,644,375 B2 * 11/2003 Palmer ..... 160/84.04
2003/0102090 A1 6/2003 Marocco ..... 160/89

* cited by examiner

BALANCED WINDOW BLIND HAVING A SPRING MOTOR FOR CONCEALED PULL CORDS THEREOF

BACKGROUND OF THE INVENTION

1. Field of the Invention

The invention relates to a window blind, more particularly to a window blind having a spring motor for concealed pull cords thereof.

2. Description of the Related Art

In U.S. Pat. No. 6,289,965, there is disclosed a conventional window blind that comprises a head rail, a bottom rail, and an expandable window covering therebetween. A pair of pull cords interconnect the head rail, the bottom rail, and the expandable window covering. A spring motor includes a frame, a drive drum, an idler gear, a take-up drum, a pair of cord spools, and a coil spring. The frame is mounted on the head rail. The drive drum is mounted rotatably on the frame and is provided with a drive gear. The idler gear is mounted rotatably on the frame and meshes with the drive gear. The take-up drum is mounted rotatably on and is concentric with the idler gear. The idler gear rotates independently of the take-up drum. Each of the cord spools is mounted rotatably on one end of the frame adjacent to a respective one of the idler gear and the drive drum, is provided with a driven gear that meshes with the respective one of the idler gear and the drive drum, and is connected to a respective one of the pull cords. The coil spring is wound on the take-up drum, has opposite ends connected to the take-up drum and the drive drum, and provides a biasing force for biasing the take-up drum to rotate in a direction for winding the pull cords on the cord spools.

The aforementioned conventional window blind achieves the purpose of concealing the pull cords with the deployment of the spring motor, and the bottom rail does not slant while being raised or lowered. However, the drive and take-up drums rotate at different speeds. In addition to this, the idler gear and the take-up drum rotate independently of one another. Further, the drive drum, the idler gear and the cord spools rotate at the same speed. This rotational speed relationship among the drive and take-up drums, the idler gear, and the cord spools results in a complicated construction for the spring motor of the conventional window blind:

SUMMARY OF THE INVENTION

Therefore, the object of the present invention is to provide a window blind that has a relatively simple spring motor for concealed pull cords thereof.

According to the present invention, a window blind comprises a head rail, a bottom rail, and an expandable window covering between the head rail and the bottom rail. A pair of pull cords interconnect the head rail, the bottom rail and the expandable window covering. A spring motor includes a frame, a drive drum, a pair of cord spools, a spiral spring, and a friction imposing mechanism. The frame is mounted on one of the head and bottom rails. The drive drum is mounted rotatably on the frame and is provided with a drive gear. Each of the cord spools is mounted rotatably on the frame, is disposed on a respective one of opposite sides of the drive drum, is provided with a driven gear that meshes with the drive gear, and is connected to a respective one of the pull cords. The spiral spring is wound on the drive drum, has opposite ends connected respectively to the drive drum and the frame, provides a biasing force for biasing the drive drum to rotate in a direction for winding the pull cords on the cord spools, and deforms from an initial state to an extent corresponding to vertical distance of the bottom rail from the head rail. The friction imposing mechanism is mounted on the frame and is operable so as to provide a friction force that acts on one of the drive drum and the pull cords. The biasing force of the spiral spring and the friction force attributed to the friction imposing mechanism cooperate to support the weight of the bottom rail and the weight of the expandable window covering that acts on the bottom rail so as to retain the bottom rail at a desired vertical distance relative to the head rail.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
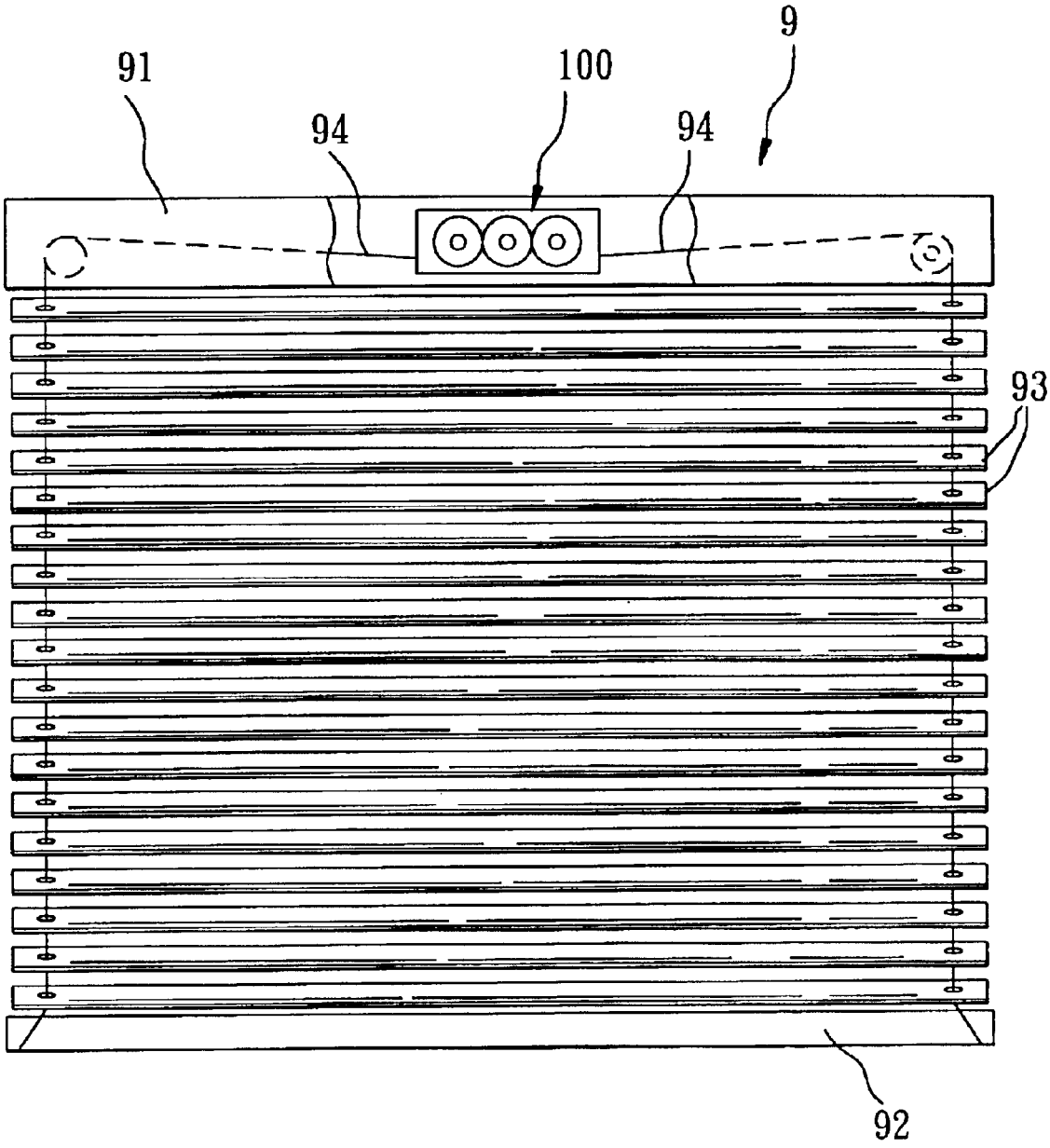
FIG. 1 is a schematic view of the first preferred embodiment of a window blind according to the present invention.

Before the present invention is described in greater detail, it should be noted that like elements are denoted by the same reference numerals throughout the disclosure.

Figure 2:
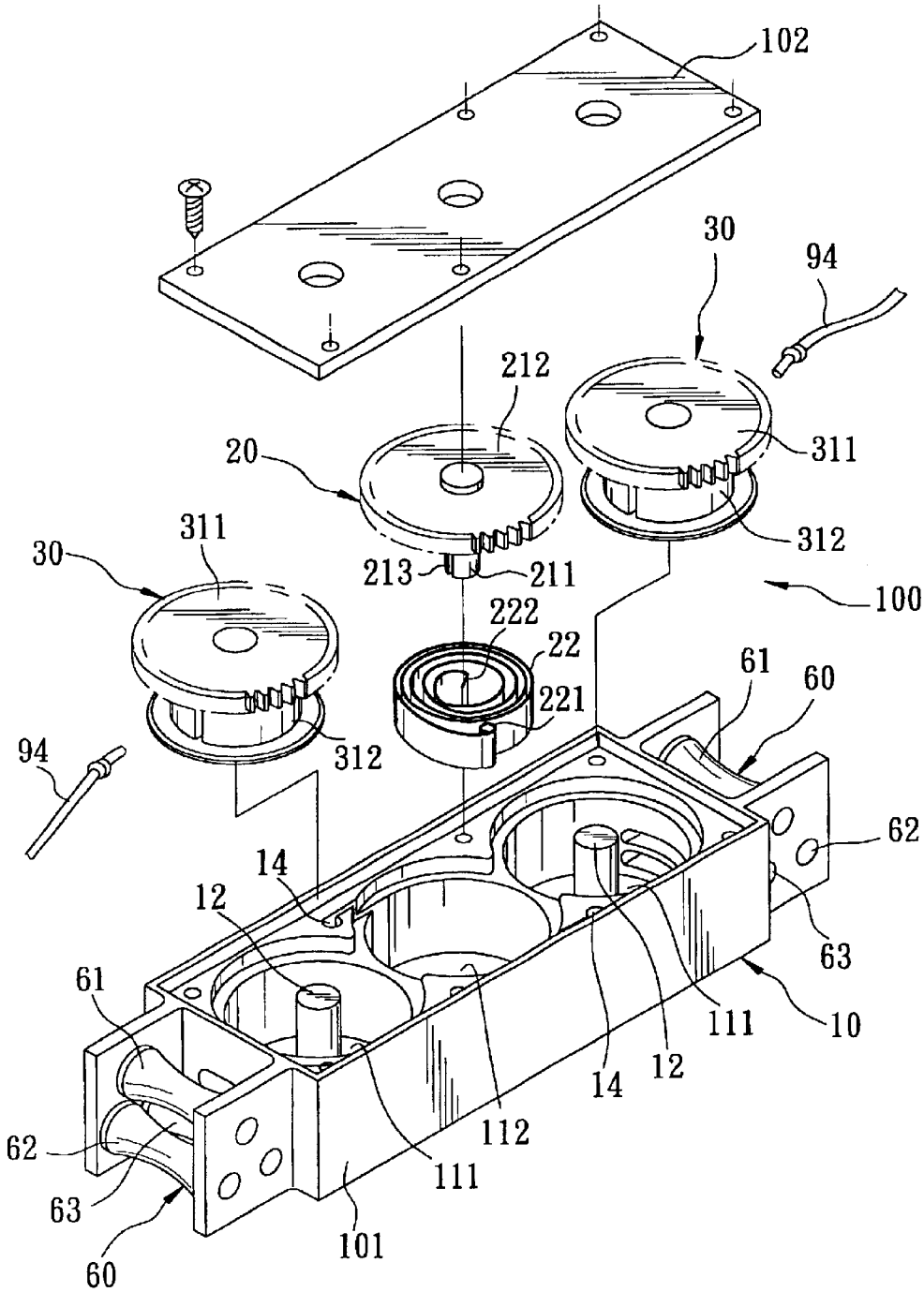
FIG. 2 is an exploded perspective view of a spring motor of the first preferred embodiment of a window blind according to the present invention.
Figure 3:
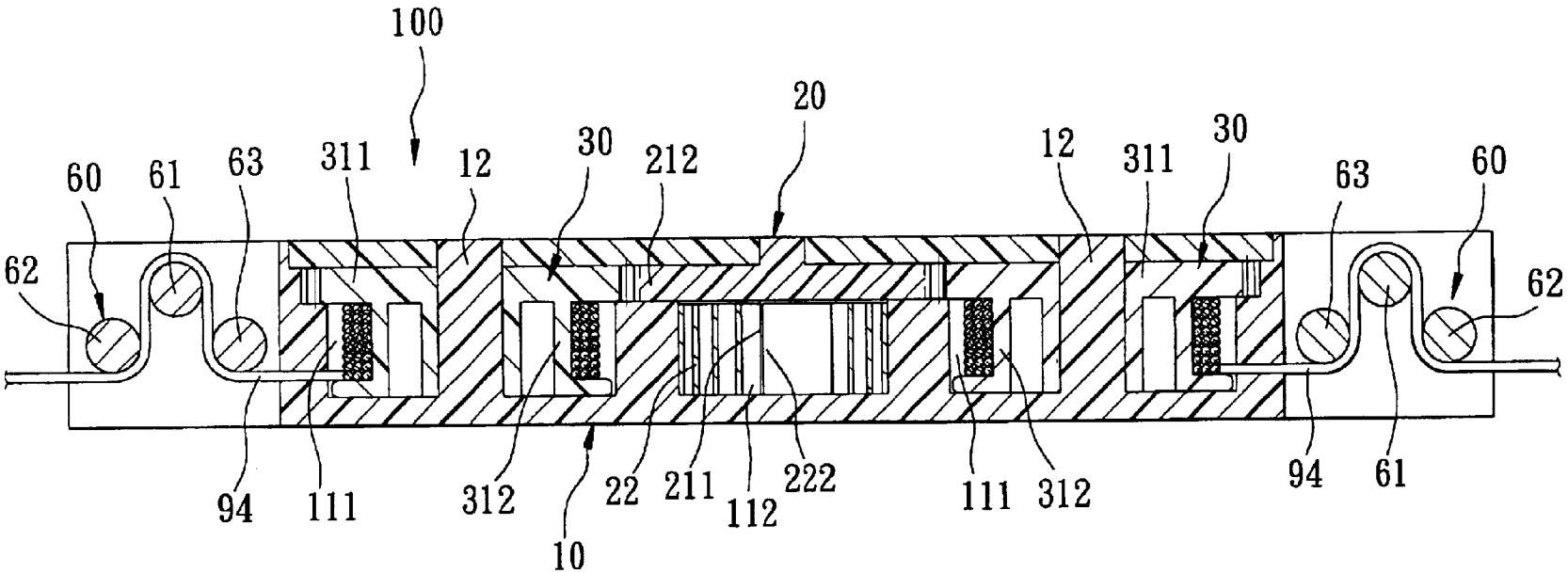
FIG. 3 is a sectional view of the spring motor illustrating a pair of pull cords wound on a pair of cord spools and trained on a pair of friction roller sets.

Referring to FIGS. 1 to 3, the first preferred embodiment of a window blind 9 according to the present invention is shown to include a head rail 91, a bottom rail 92, and an expandable window covering 93 therebetween. A pair of pull cords 94 interconnect the head rail 91, the bottom rail 92 and the expandable window covering 93. In this embodiment, the expandable window covering 93 includes a plurality of parallel slats suspended between the head rail 91 and the bottom rail 92 in a conventional manner with the use of ladder cords (not shown). A spring motor 100 of the window blind 9 includes a frame 10, a drive drum 20, a pair of cord spools 30, a spiral spring 22, and a friction imposing mechanism 60.

While the frame 10 is mounted on the head rail 91. In this embodiment, it is apparent to one skilled in the art that the frame 10 can be mounted instead on the bottom rail 92. The drive drum 20 is mounted rotatably on the frame 10 and is provided with a drive gear 212. Each of the cord spools 30 is mounted rotatably on the frame 10, is disposed on a respective on one of opposite sides of the drive drum 20, is provided with a driven gear 311, and is connected to a respective on one of the pull cords 94. The spiral spring 22 is wound on the drive drum 20, has opposite inner and outer ends 222, 221 connected to a respective one of the drive drum 20 and the frame 10, provides a biasing force for biasing the drive drum 20 to rotate in a direction for winding the pull cords 94 on the cord spools 30, and deforms from an initial state to an extent corresponding to vertical distance of the bottom rail 92 from the head rail 91. In this embodiment, the friction imposing mechanism 60 is mounted on the frame 10 and is operable so as to provide a friction force that acts on the pull cords 94. The frame 10 is formed with left and right compartments 111 and a middle compartment 112 therebetween. The drive drum 20 is disposed in the middle compartment 112, and has a drive shaft 211 that is connected to the drive gear 212 and that is formed with a slit 213 for engaging the inner end 222 of the spiral spring 22. The middle compartment 112 is formed with a pair of slits 14 for engaging selectively the outer end 221 of the spiral spring 22. The drive gear 212 extends radially out of the middle compartment 112. Each of the left and right compartments 111 has an axle 12 disposed therein for mounting rotatably a respective one of the cord spools 30 in the left and right compartments 111. Each of the cord spools 30 has a driven shaft 312 that is connected to a respective one of the driven gears driven gears 311 and that is journalled to a respective one of the axles 12. Each of the driven gears 311 extends radially out of a respective one of the left and right compartments 111 and meshes with the drive gear 212. Preferably, the frame 10 includes a casing part 101 that is formed with the left, middle and right compartments 111, 113 and that has an open side, and a cover part 102 that is mounted on the casing part 101 to cover the open side of the casing part 101 and to retain the cord spools 30 and the drive drum 20 in the casing part 101.

With further reference in FIG. 3, the friction imposing mechanism 60 of this embodiment includes a pair of friction roller sets. Each of the friction roller sets is mounted on one end of the frame 10 adjacent to a respective one of the cord spools 30, and includes three friction rollers 61, 62, 63 arranged in a triangular formation. Each of the pull cords 94 is trained on the friction rollers 61, 62, 63 of a respective one of the friction roller sets.

Figure 4:
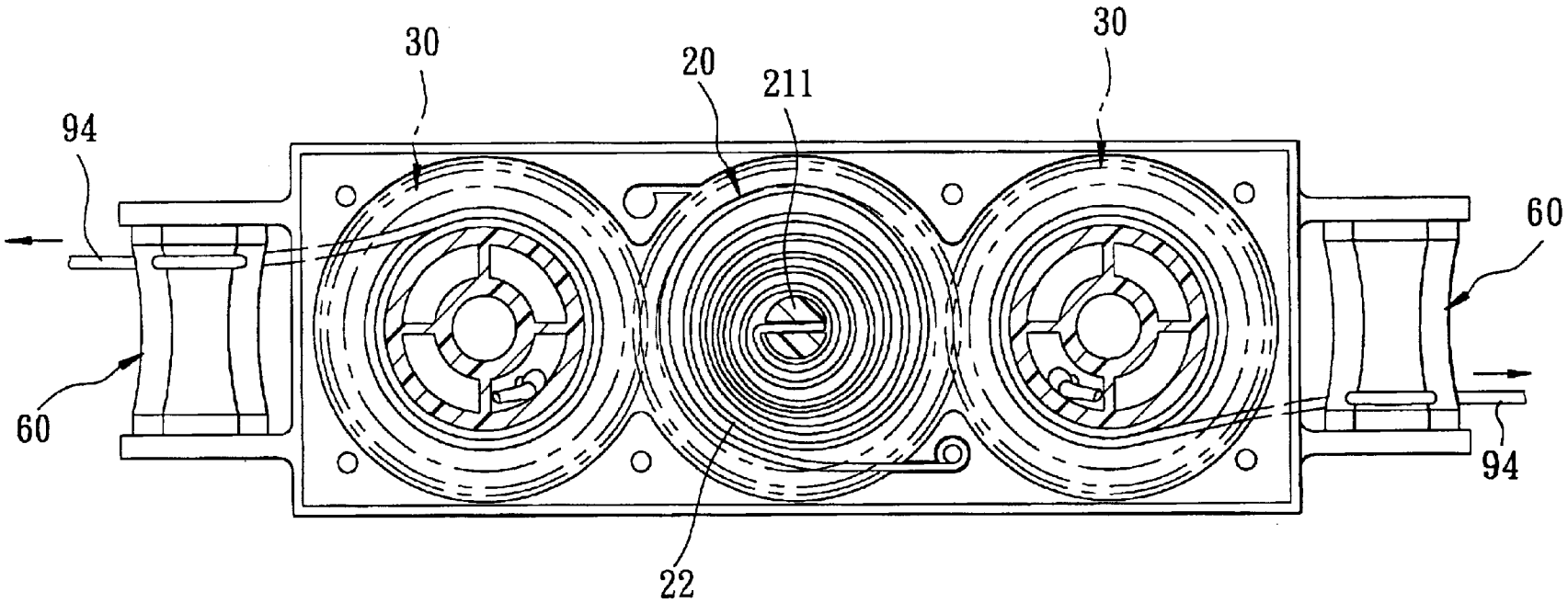
FIG. 4 is a schematic view of the spring motor illustrating a spiral spring being deformed, and the pull cords being unwound from the cord spools.

Referring to FIG. 4, when the bottom rail 92 (see FIG. 1) is pulled downwardly so as to lower the same, each of the cord spools 30 rotates in a counter-clockwise direction, which results in unwinding of the pull cords 94 from the driven shafts 312 of the cord spools 30, in axial rotation of the drive drum 20, and in radial contraction of the spiral spring 22. Once the bottom rail 92 is lowered to a lower limit position, the spiral spring 22 is deformed such that the spiral spring 22 wraps around the drive shaft 211 of the drive drum 20. At this time, the biasing force of the spiral spring 22 is at a maximum, and the weight of the expandable window covering 93 (see FIG. 1) that acts on the bottom rail 92 is at a minimum. As such, the external force that is required to initiate raising of the bottom rail 92 to retract the expandable window covering 93 is at a minimum.

In addition, in the absence of the external force, the biasing force of the spiral spring 22 and the friction force attributed to the friction imposing mechanism 60 cooperate to support the weight of the bottom rail 92 and the weight of the expandable window covering 93 that acts on the bottom rail 92 so as to retain the bottom rail 92 at a desired vertical distance relative to the head rail 91 (see FIG. 1).

Figure 5:
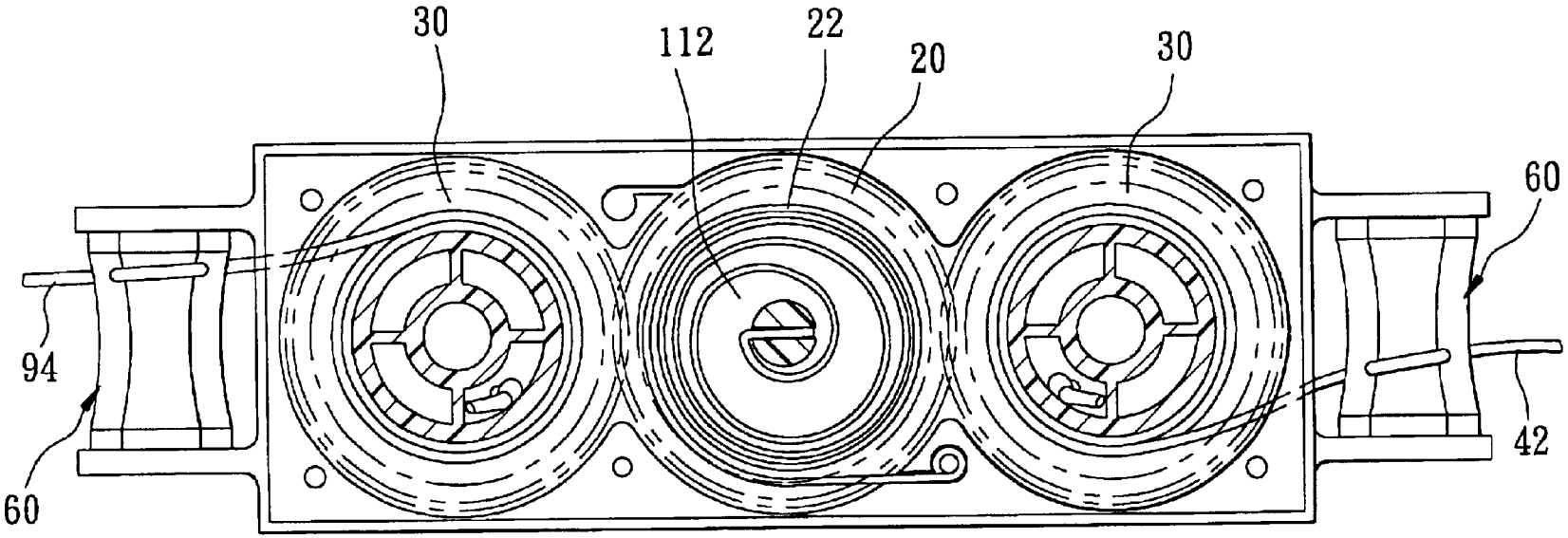
FIG. 5 is a schematic view of the spring motor illustrating the spiral spring being restored to an initial state on a drive drum, and the pull cords being wound on the cord spools.

With further reference to FIG. 5, when the bottom rail 92 is pushed upwardly so as to raise the same, due to the biasing force of the spiral spring 22 and slackening of the pull cords 94, each of the cord spools rotates in a clockwise direction, which results in winding of the pull cords 94 on the driven shafts 312 of the cord spools 30, in an opposite axial rotation of the drive drum 20, and in radial expansion of the spiral spring 22. Once the bottom rail 92 is raised to an upper limit position, the spiral spring 22 is restored to the initial state such that an outer wound of the spiral spring 22 abuts against an inner wall of the middle compartment 112. At this time, the biasing force of the spiral spring 22 is at a minimum, and the weight of the expandable window covering 93 that acts on the bottom rail 92 is at maximum. As such, the external force that is required to initiate lowering of the bottom rail 92 to expand the expandable window covering 93 is also at a minimum.

It is noted that the cord spools 30 rotate at the same speed. Therefore, the pull cords 94 are wound on and unwound from the cord spools 30 at equal lengths. As such, the bottom rail 92 does not slant and is maintained in a horizontal orientation with respect to the head rail 91 while being raised or lowered.

Figure 6:
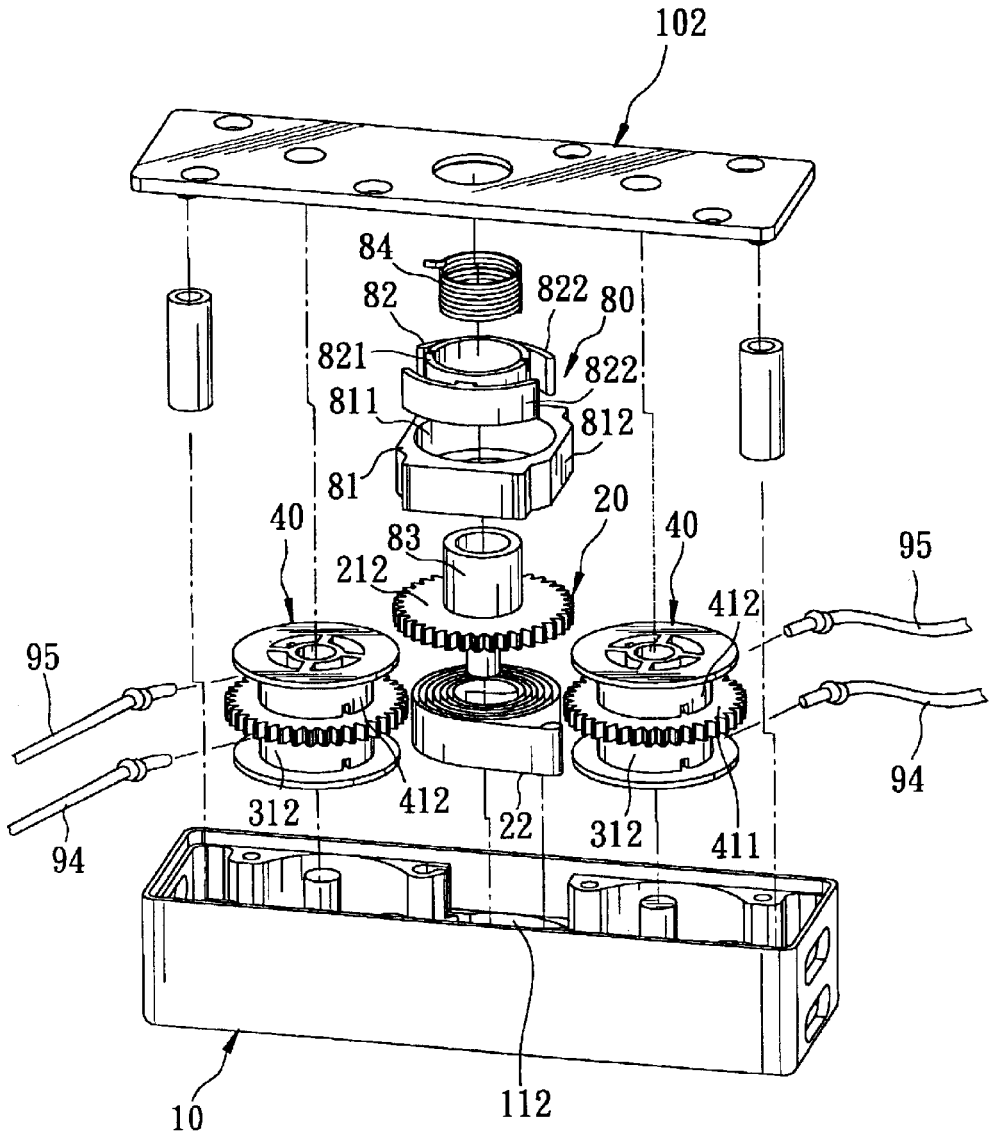
FIG. 6 is an exploded perspective view of a spring motor of the second preferred embodiment of a window blind according to the present invention.

FIG. 6 illustrates a spring motor of the second preferred embodiment of a window blind according to the present invention. When compared with the first preferred embodiment, the window blind of this embodiment further comprises a pair of auxiliary pull cords 95. The spring motor further includes a pair of auxiliary cord spools 40. Each of the auxiliary cord spools 40 has a driven shaft 412 that is mounted to rotate with a respective one of the cord spools 30 and that is connected to a respective one of the auxiliary pull cords 95. The construction as such provides adequate support to a bigger and heavier window blind.

In this embodiment, the friction imposing mechanism 80 is mounted on the frame 10, is operable so as to provide a friction force which acts on the drive drum 20, and includes an annular member 81, a braking member 82, a post 83, and a coil spring 84.

The annular member 81 is secured on the frame 10, is vertically aligned with the drive drum 20, and has annular inner and rectangular outer wall surfaces 811, 812. The braking member 82 is disposed in the annular member 81, and has a tubular part 821 and a pair of braking parts 822. Each of the braking parts 822 is connected to, is disposed radially and outwardly on a respective one of opposite sides of the tubular part 821, and is in friction engagement with the inner wall surface 811 of the annular member 81. The post 83 is mounted on the drive drum 20 and extends into the tubular part 821 of the braking member 82. The coil spring 84 is sleeved fittingly on the post 83 in the tubular part 821 of the braking member 82, is wound in a same winding direction as the spiral spring 22, and has one end fastened to the braking member 82.

Figure 7:
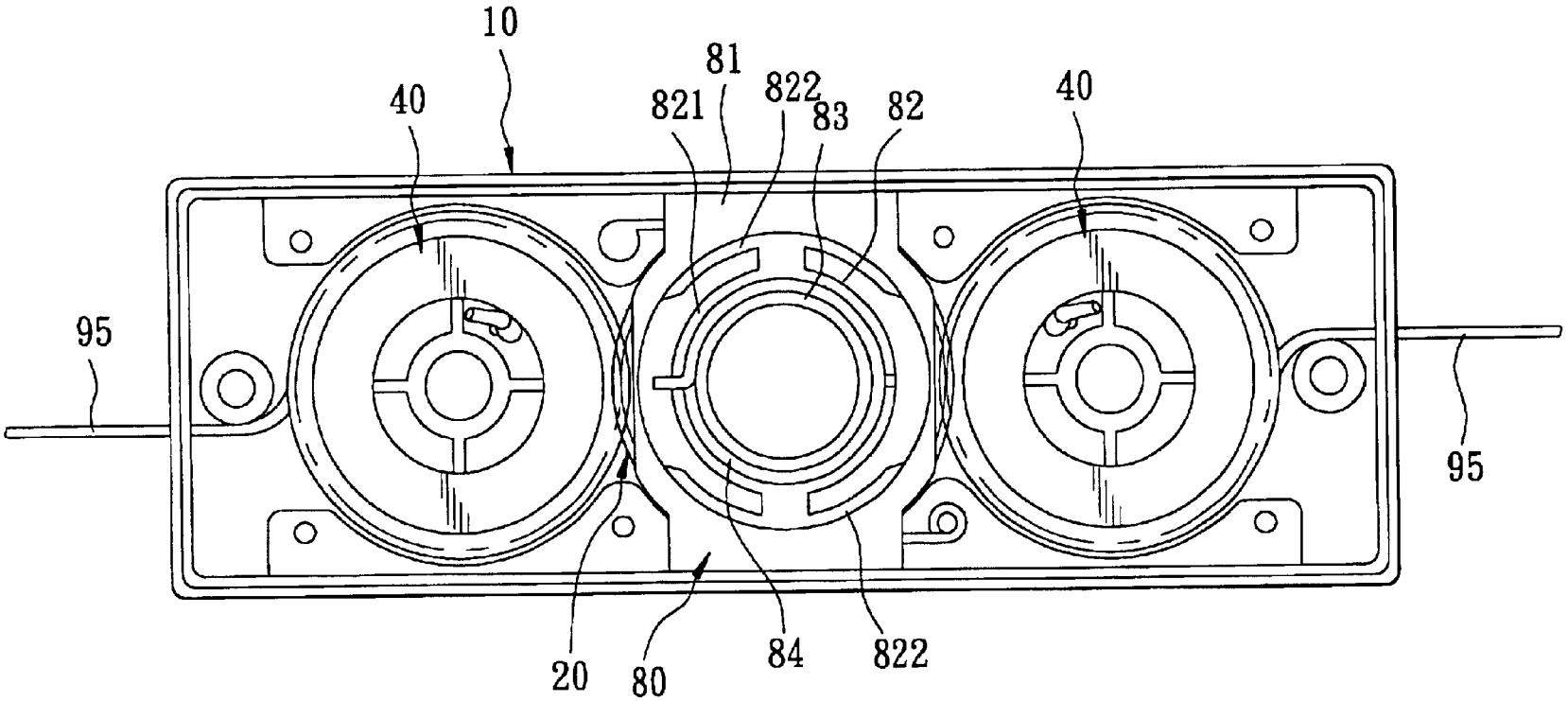
FIG. 7 is a schematic view of the spring motor illustrating operation of a friction imposing mechanism thereof.

Referring to FIG. 7, since the operation of the auxiliary cord spools 40 and the auxiliary pull cords 95 of the second preferred embodiment is similar to those described hereinabove in connection with the cord spools 30 and the pull cords 94 of the previous preferred embodiment, a detailed description of the same will be dispensed with herein for the sake of brevity.

After raising the bottom rail 92 (see FIG. 1), the bottom rail 92 tends to move downward when the external force applied to raise the bottom rail 92 is removed. This results in tendency of the drive drum 20 to rotate in a first direction the same as the winding direction. The rotation of the drive drum 20, which in turn directly rotates the post 83, enables the coil spring 84 to contract radially and to engage with the post 83. The coil spring 84 urges the braking member 82 to rotate so that friction force between the braking member 82 and the annular member 81 is transmitted to the drive drum 20. As such, the bottom rail 92 can be retained at a desired vertical distance relative to the head rail 91 (see FIG. 1).

Further, when the bottom rail 92 is raised, this results in rotation of the drive drum 20 in a second direction opposite to the first direction. The rotation of the drive drum 20, which in turn directly rotates the post 83, enables the coil spring 84 to expand radially and not to rotate with the post 83. Accordingly, the friction force between the braking member 82 and the annular member 81 is not transmitted to the drive drum 20. As such, the friction force that is provided by the friction imposing mechanism 80 does not act on the drive drum 20 while the bottom rail 92 is being raised.

It has thus been shown that the window blind 9 of this invention includes a spring motor 100 that dispenses with an idler gear and a take-up drum. As such, the spring motor 100 utilized in this invention is relatively simple to construct as compared to the aforesaid prior art. While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind comprising:

a head rail;

a bottom rail;

an expandable window covering between said head rail and said bottom rail;

a pair of pull cords interconnecting said head rail, said bottom rail and said expandable window covering; and a spring motor including a frame mounted on one of said head rail and said bottom rail, a drive drum mounted rotatably on said frame and provided with a drive gear, a pair of cord spools mounted rotatably on said frame and disposed on opposite sides of said drive drum, each of said cord spools being provided with a driven gear that meshes with said drive gear and being connected to a respective one of said pull cords, a spiral spring wound on said drive drum and having opposite ends connected to said drive drum and said frame, respectively, said spiral spring providing a biasing force for biasing said drive drum to rotate in a direction for winding said pull cords on said cord spools, and a friction imposing mechanism mounted on said frame and operable so as to provide a friction force that acts on one of said drive drum and said pull cords;

wherein said spiral spring deforms from an initial state to an extent corresponding to vertical distance of said bottom rail from said head rail; and wherein said biasing force of said spiral spring and said friction force attributed to said friction imposing mechanism cooperate to support the weight of said bottom rail and the weight of said expandable window covering that acts on said bottom rail so as to retain said bottom rail at a desired vertical distance relative to said head rail.

2. The window blind as claimed in claim 1, wherein said expandable window covering includes a plurality of parallel slats.

3. The window blind as claimed in claim 1, wherein said frame is formed with left and right compartments, and a middle compartment between said left and right compartments, each of said left and right compartments having an axle disposed therein for mounting rotatably a respective one of said cord spools in said left and right compartments, said drive drum being disposed in said middle compartment.

4. The window blind as claimed in claim 3, wherein said drive drum has a drive shaft connected to said drive gear and formed with a slit for engaging one of said opposite ends of said spiral spring.

5. The window blind as claimed in claim 3, wherein said frame includes a casing part formed with said left, middle and right compartments and having an open side, and a cover part mounted on said casing part to cover said open side of said casing part and to retain said cord spools and said drive drum in said casing part.

6. The window blind as claimed in claim 1, wherein said friction imposing mechanism includes a pair of friction roller sets, each of which is mounted on one end of said frame adjacent to a respective one of said cord spools, each of said friction roller sets including three friction rollers arranged in a triangular formation, each of said pull cords being trained on said friction rollers of a respective one of said friction roller sets.

7. The window blind as claimed in claim 1, wherein said friction imposing mechanism includes:

an annular member secured on said frame and vertically aligned with said drive drum, said annular member having an annular inner wall surface;

a braking member disposed in said annular member and having a tubular part and a braking part connected to and disposed radially and outwardly of said tubular part, said braking part being in friction engagement with said inner wall surface of said annular member;

a post mounted on said drive drum and extending into said tubular part of said braking member; and a coil spring sleeved fittingly on said post in said tubular part of said braking member and wound in a same winding direction as said spiral spring, said coil spring having one end fastened to said braking member;

wherein rotation of said drive drum in a first direction the same as the winding direction enables said coil spring to contract radially so that friction force between said braking member and said annular member is transmitted to said drive drum; and wherein rotation of said drive drum in a second direction opposite to the first direction enables said coil spring to expand radially so that the friction force between said braking member and said annular member is not transmitted to said drive drum.

* * * * *